US009367038B1

(12) United States Patent
Villard et al.

(10) Patent No.: US 9,367,038 B1
(45) Date of Patent: Jun. 14, 2016

(54) BALANCE SPRING STUD FOR A TIMEPIECE

(71) Applicant: Montres Breguet S.A., L'Abbaye (CH)

(72) Inventors: Gaetan Villard, L'Abbaye (CH); Lucien Germond, Granson (CH); Polychronis Nakis Karapatis, Premier (CH); Stephane Beugin, Les Rousses (FR); Sylvain Marechal, Bois-d'Amont (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 14/873,533

(22) Filed: Oct. 2, 2015

(30) Foreign Application Priority Data

Nov. 26, 2014 (EP) ..... 14194961

(51) Int. Cl.

| | |
|---|---|
| ***G04B 17/06*** | (2006.01) |
| ***G04B 17/32*** | (2006.01) |
| ***G04B 15/06*** | (2006.01) |
| *G04B 18/02* | (2006.01) |

(52) U.S. Cl.
CPC ..... *G04B 17/325* (2013.01); *G04B 15/06* (2013.01); *G04B 17/06* (2013.01); *G04B 18/026* (2013.01)

(58) Field of Classification Search
CPC .... G04B 17/06; G04B 17/066; G04B 17/063; G04B 17/325; G04B 18/026; G04B 15/06
See application file for complete search history.

(56) References Cited

U.S. PATENT DOCUMENTS 5,617,377 A * 4/1997 Perret, Jr. ..... A44C 5/14 24/168
7,018,092 B2 * 3/2006 Muller ..... G04B 17/063 267/272
8,100,579 B2 * 1/2012 Levingston ..... G04B 17/222 368/170
9,058,021 B2 * 6/2015 Cordier ..... G04B 15/14
2008/0101162 A1 5/2008 Born
2011/0199866 A1 * 8/2011 Zaugg ..... G04D 3/0041 368/177

FOREIGN PATENT DOCUMENTS

CH 317 531 11/1956
EP 1 580 625 A1 9/2005

OTHER PUBLICATIONS

European Search Report issued Jul. 17, 2015 in European Application 14194961, filed on Nov. 26, 2014 ( with English Translation and written opinion).

* cited by examiner

*Primary Examiner* — Sean Kayes
(74) *Attorney, Agent, or Firm* — Oblon, McClelland, Maier & Neustadt, L.L.P.

(57) ABSTRACT

Balance spring stud including, around a housing receiving a balance spring of reference thickness, a one-piece component made of a shape memory alloy and including two lugs, each arranged to rest on one of the surfaces of the balance spring, and wherein, in the free state, the minimum width of the air gap of the lugs is greater than the maximum value of the reference thickness when the component is in an open position corresponding to a martensitic structure, and wherein the maximum width of the air gap is less than the minimum value of the reference thickness when the component is in a closed position corresponding to an austenitic structure, and the balance spring includes an area of lesser thickness having a minimum thickness equal to the reference thickness, surrounded by areas of large thickness having a minimum thickness greater than the reference thickness.

11 Claims, 1 Drawing Sheet

BALANCE SPRING STUD FOR A TIMEPIECE

This application claims priority from European Patent Application No. 14194961.0 filed on Nov. 26, 2014, the entire disclosure of which is hereby incorporated herein by reference.

FIELD OF THE INVENTION

The invention concerns an assembly including a balance spring which comprises two opposite lateral surfaces separated by a reference thickness, and a balance spring stud including a housing dimensioned to receive said balance spring, said stud including, around said housing, at least one one-piece component made of a shape memory alloy and including at least two lugs defining together an air-gap and each arranged to rest on one of said opposite lateral surfaces of said balance spring, and wherein, in the free state, the minimum width of said air-gap is greater than the maximum value of said reference thickness when said component is in an open position corresponding to a martensitic structure, and wherein the maximum width of said air-gap is smaller than the minimum value of said reference thickness when said component is in a closed position corresponding to an austenitic structure.

The invention also concerns a timepiece movement including at least one such assembly.

The invention also concerns a timepiece including at least one such movement, and/or at least one such assembly.

The invention also concerns a method for attaching a balance spring to a balance spring stud.

The invention concerns the field of mechanical oscillator mechanisms for timepieces, including a balance spring.

BACKGROUND OF THE INVENTION

Mechanical oscillator mechanisms for timepieces, including a balance spring, generally include a balance spring stud for attaching the outer end of the balance spring.

The attachment of the balance spring to the stud is generally achieved by adhesive bonding, which is not perfectly reproducible, and may result in contamination of the timepiece movement.

CH Patent Application No 317531A in the name of EBAUCHES BETTLACH SA describes a balance spring stud with a slot, made of a plastically deformable material for permanently attaching the stud and the balance spring.

EP Patent Application No 1580625A1 in the name of ASULAB SA describes the attachment of a lifting-piece in a pallet lever housing; the portion including this housing is made of a shape memory alloy capable of undergoing a reversible transformation between an austenitic phase and a martensitic phase.

SUMMARY OF THE INVENTION

The invention proposes to provide an alternative to the adhesive bonding of the balance spring in the stud, and to replace it with a reproducible attachment of the balance spring, which is less dependent on the operator performing the assembly.

To this end, the invention concerns an assembly including a balance spring which comprises two opposite lateral surfaces separated by a reference thickness, and a balance spring stud dimensioned to receive said balance spring, according to claim 1.

The invention also concerns a timepiece movement including at least one such assembly.

The invention also concerns a timepiece including at least one such movement, and/or at least one such assembly.

The invention also concerns a method for attaching a balance spring to a balance spring stud, which can easily be automated using a manipulator robot comprising means of heating or cooling in a localised and virtually instantaneous manner, according to claim 10.

The invention also concerns another method for attaching a balance spring to a stud, according to claim 11.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
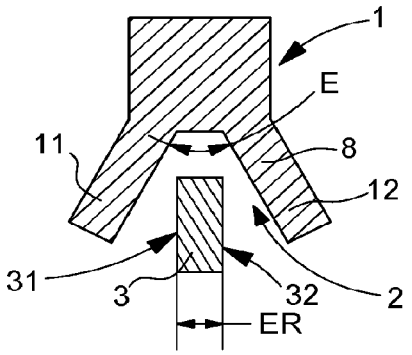
FIG. 1 shows a schematic transverse cross-sectional view of the balance spring, presented in a housing comprised in a stud of variable geometry according to the invention, with said stud in an open position.

Mechanical oscillator mechanisms for timepieces, include a balance spring whose outer end is attached to a stud, which is in turn attached to a plate, a bridge, a balance-cock or suchlike.

The invention proposes to ensure the attachment of the balance spring in a reproducible manner, which is less dependent on the operator performing the assembly and preferably achievable with automated production means, such as an assembly robot or similar, for gripping and positioning the components in relation to each other, wherein said robot is capable of selectively applying localised and virtually instantaneous heating or cooling to said components.

The invention therefore concerns a timepiece balance spring stud 1 including a housing 2 for receiving a balance spring 3, this balance spring 3 including, in a conventional manner, two opposite lateral surfaces 31, 32, separated by a reference thickness ER.

According to the invention, this stud 1 includes, around housing 2, at least one one-piece component 8 made of a shape memory alloy.

The shape memory alloy may be chosen from various families of materials, particularly and in a non-limiting manner, heat-activated shape memory alloys, magnetically-activated shape memory alloys, or shape memory polymers.

The invention is described here in a particular non-limiting example with a heat-activated shape memory alloy.

A distinction is generally made, for such shape memory alloys, between a martensitic state and an austenitic state, which correspond to different structures of the material and to different spatial distributions of atoms in space. This component 8 includes at least two lugs 11, 12 which define together an air-gap E and are each arranged to rest on one of the opposite lateral surfaces 31, 32 of such a balance spring 3.

In the free state, the minimum width of this air-gap E is greater than the maximum value of reference thickness ER when component 8 is in an open position corresponding to a martensitic structure, and the maximum width of air-gap E is less than the minimum value of reference thickness ER when component 8 is in a closed position corresponding to an austenitic structure.

Figure 2:
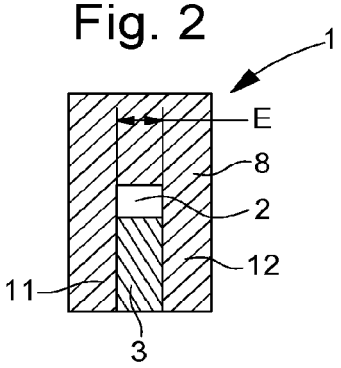
FIG. 2 shows, in a similar manner to FIG. 1, the same assembly formed of the balance spring stud and the balance spring, with the stud in a closed position where the balance spring is clamped between two lugs of the stud.

FIGS. 1 and 2 illustrate these two open and closed positions of component 8 around balance spring 3. Lugs 11 and 12 clamp balance spring 3, preferably with pressure over the entire height of lateral surfaces 31 and 32 of the balance spring, and over the entire thickness L of stud 1.

Figure 3:
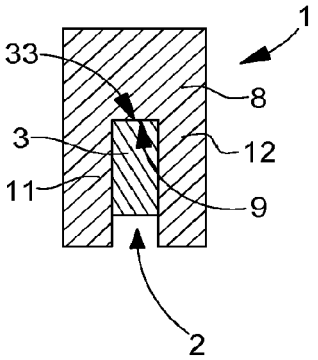
FIG. 3 shows, in a similar manner to FIG. 2, an assembly wherein the balance spring is in an abutment position on a bearing face of the stud, and with the stud in a closed position where the balance spring is clamped between two lugs of the stud.

In a particular embodiment, as seen in FIG. 3, housing 2 of stud 1 includes an axial abutment surface 9 arranged to receive in abutment an edge 33 of balance spring 3.

In a particular embodiment, as seen in FIGS. 1 to 4, stud 1 is made in one-piece with component 8.

In a particular embodiment of balance spring stud 1, the shape memory alloy is selected such that stud 1 can withstand a minimum operating temperature TSMIN of −20° C. without any significant modification of its clamping force.

In another particular embodiment of balance spring stud 1, the shape memory alloy is selected such that stud 1 can withstand a maximum operating temperature TSMAX of +70° C. without any significant modification of its clamping force.

The invention further concerns an assembly 10 including such a balance spring 3, which includes two opposite lateral surfaces 31, 32 separated by a reference distance ER, and one such stud 1 dimensioned to receive balance spring 3.

Figure 5:
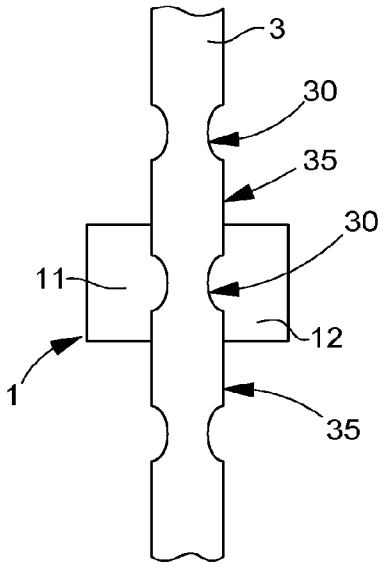
FIG. 5 shows a schematic bottom view of the stud of FIG. 4 cooperating in a closed position clamping a balance spring which includes a series of areas of varying degrees of thickness.
Figure 6:
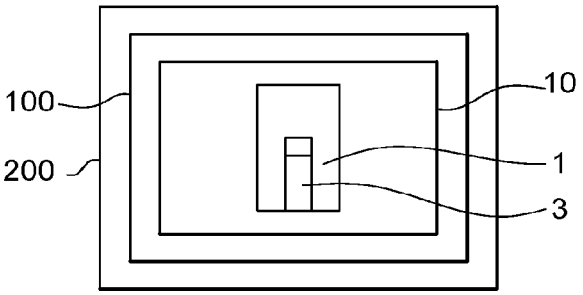
FIG. 6 shows a block diagram of a watch including a movement comprising an assembly which is formed, in turn, of a balance spring and a stud according to the invention.

According to the invention, as seen in FIG. 5, balance spring 3 locally includes at least one area of lesser thickness 30 whose minimum thickness is reference thickness ER, for which stud 1 is devised, and which is surrounded by areas of large thickness 35 whose minimum thickness is greater than reference thickness ER.

More specifically, balance spring 3 includes an alternation of such areas of lesser thickness 30 and such areas of large thickness 35, for adjustment of the active length of balance spring 3 through the discrete cooperation of stud 1 with one of these areas of lesser thickness 30. Balance spring 3 may also, be graduated at these various active length adjustment positions.

In a particular embodiment, each area of lesser thickness 30 has a length that is substantially equal or slightly greater than the thickness of lugs 11, 12 of stud 1.

Figure 4:
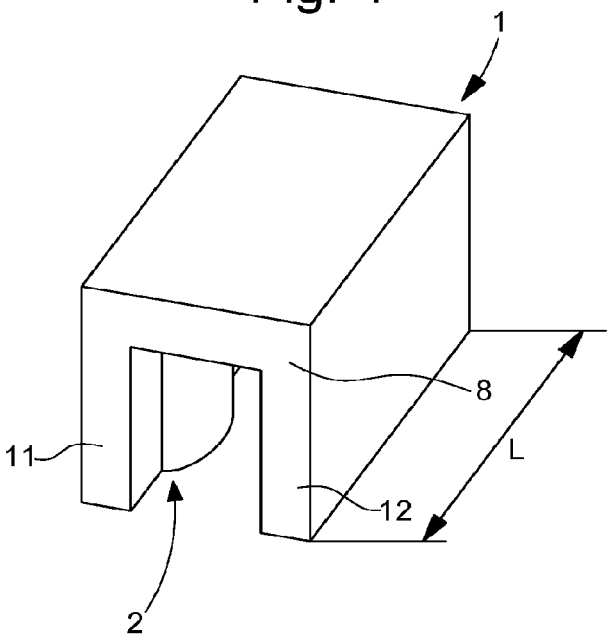
FIG. 4 shows a schematic perspective view of a stud according to the invention, in the free state, in a closed position and including two lugs having a shaped profile.

In a particular embodiment, illustrated by FIGS. 4 and 5, these areas of lesser thickness 30 all have the same profile, and the lugs 11, 12 of stud 1 each have a complementary profile to the profile of balance spring 3 which faces them in each area of lesser thickness 30.

The invention also concerns a timepiece movement 100 including at least one such stud 1 and/or one such assembly 10.

The invention also concerns a timepiece 200 including at least one such movement 100, and/or at least one such stud 1 and/or one such assembly 10.

The assembly method includes successive phases:

- a first, initial deformation phase of the shape memory alloy component 8 in a martensitic state and at a lower temperature than a first transformation start temperature As, characteristic of the start of the transformation of the martensitic structure into an austenitic structure on heating;
- followed by a second phase of cooperation between component 8 and balance spring 3, still in the martensitic state and at a lower temperature than first transformation temperature As;
- a third phase, in which the clamping of component 8 on balance spring 3 is achieved by heating to a higher temperature than a second transformation end temperature Af, which is characteristic of the end of transformation from the martensitic structure to the austenitic structure on heating, and which is thus higher than the first transformation temperature As. The assembly then maintains its clamping force provided it does drop below a third transformation temperature Ms again, which is characteristic of the start of transformation of the austenitic structure to the martensitic structure upon cooling (the end of this transformation corresponding to a fourth transformation temperature Mf). The use of a material with large hysteresis (difference between Ms and As), for example, allows for assembly at a temperature around ambient temperature (close to 20° C.), limited heating and the clamp-fit then maintain the properties of the material over a wide range of utilisation.

The object is to avoid dropping below the transformation temperature Ms during operation, so as to avoid modifying the clamp-fit by any, even partial, phase transformation (i.e. without necessarily attaining the fourth transformation temperature Mf at which transformation from the austenitic structure into the martensitic structure is completed).

In one embodiment, the shape memory alloy forming component 8 is chosen to allow a minimum operating temperature TSMIN of −20° C.

In a second embodiment, the shape memory alloy forming component 8 is chosen to allow a maximum operating temperature TSMAX of +70° C.

The transformation and attachment temperatures must be low enough to prevent the balance spring from becoming loose if the watch in which it is incorporated remains cold.

In another specific embodiment, the component is made of a "Nitinol" type nickel titanium alloy, in a first form at a temperature below −40° C., and in a second form at ambient temperature between −20° C. and +70° C., said second form ensuring the clamping force required for proper and controlled friction of the balance spring. Medical, and particularly orthodontic tools can achieve very fast cooling to around −50° C. or −60° C., to even lower temperatures, to make the component take the first form which allows it to be placed onto the stud body. The assembly then simply needs to be brought to the temperature of the assembly workshop, conventionally close to +20° C., to ensure the clamp-fit of the component in its second form, and the friction torque measurement test can immediately be performed to validate the component for immediate use in a movement.

The invention also concerns an assembly method, which can easily be automated using a manipulator robot comprising means of heating or cooling in a localised and virtually instantaneous manner, via which various successive steps are performed.

According to the invention, this method for attaching a balance spring (3) to a stud (1) includes the following series of steps:

a balance spring stud 1 is produced for receiving a balance spring 3 of reference thickness ER, the stud including, around a housing 2 provided for receiving balance spring 3, at least one one-piece component 8 made of a shape memory alloy and including at least two lugs 11, 12, defining together an air-gap E wherein, in the free state of stud 1, the minimum width of air-gap E is greater than the maximum value of reference thickness ER when component 8 is in an open position in a martensitic structure, and the maximum width of air-gap E is less than the minimum value of reference thickness ER when component 8 is in a closed position in an austenitic structure;

there is effected a first phase of deformation to open component 8 in a martensitic state and at a lower temperature than a first transformation start temperature As, characteristic of the start of transformation of the martensitic structure into an austenitic structure upon heating;

a balance spring 3 is inserted into housing 2 in a determined position or until a stop position is reached;

there is effected a second phase of deformation to close component 8, in which lugs 11, 12 are clamped onto balance spring 3 by heating component 8 to a higher temperature than a second transformation end temperature Af.

In a variant of this method for attaching a balance spring 3 to a stud 1, the method includes the following series of steps:

a balance spring stud 1 is produced for receiving a balance spring 3 of reference thickness ER, the stud including, around a housing 2 provided for receiving balance spring 3, at least one one-piece component 8 made of a shape memory alloy and including at least two lugs 11, 12, defining together an air-gap E where, in the free state of stud 1, the minimum width of air-gap E is greater than the maximum value of reference thickness ER when component 8 is in an open position in a martensitic structure, and in that the maximum width of air-gap E is less than the minimum value of reference thickness ER when component 8 is in a closed position in an austenitic structure at an operating temperature;

there is effected a first phase of deformation to open component 8 in a martensitic structure;

balance spring 3 is inserted in housing 2, and the spring and housing are properly positioned with respect to each other;

they are maintained in position until the ambient temperature is reached again.

In a variant, there is effected a first phase of deformation to open component 8 in a martensitic structure, then cooling or heating is performed on shape memory alloy component 8, then balance spring 3 is inserted in housing 2, and they are properly positioned with respect to each other. It is understood that no further cooling or heating must be performed before the balance spring is inserted.

Temperatures $M_s$ and $M_f$ must be low enough to prevent the balance spring from becoming loose if the watch remains cold. Ideally, $A_s$ and $A_f$ are around 20° C. to 30° C., but may also have different values.

Those skilled in the art will know how to extend the application of the invention to other configurations, notably to a reverse application of the invention.

In its stored state, prior to assembly of the balance spring, the stud may either have parallel branches, in which case a spacing operation is performed just before assembly, or have divergent branches, in which case the balance spring is simply presented in position. In either case, the spacing must be the result of prior deformation, so that the shape memory can return to the pre-deformation state.

The technical terms contained in the above description (austenite, martensite $A_s$, $A_f$, $M_s$, $M_f$) are mainly relevant for heat-activated shape memory alloys. These concepts nonetheless apply to magnetically-activated shape memory alloys and to shape memory polymers.

In the case of magnetically-activated shape memory alloys, notions of transition temperatures must be replaced by notions of magnetic field thresholds. This solution is advantageous, in the case where positioning occurs under a magnetic field, to remove any possibility of loosening at a low temperature.

In the case of shape memory polymers, which are often block copolymers, the "austenitic" and "martensitic" phases do not actually exist, and the transition occurs on a molecular level at a transition temperature. This temperature may correspond to the vitreous transition temperature of one of the blocks or to its melting temperature.

In a non-limiting manner, shape memory materials that can be used for implementing the invention include:

either heat-activated shape memory alloys:

Ag—Cd
Au—Cd
Co—Ni—Al
Co—Ni—Ga
Cu—Al—Ni
Cu—Al—Be
Cu—Zn—Al
Cu—Zn—Si
Cu—Zn—Sn
Cu—Zn
Cu—Sn
In—Ti
Mn—Cu
Nb—Ru
Ta—Ru
Ni—Al
Ni—Ti
Ni—Ti—Fe
Ni—Ti—Cu
Ni—Ti—Nb
Ni—Ti—Pd
Ni—Ti—Hf
Fe—Pt
Fe—Mn—Si
Fe—Pd
Fe—Ni—Co—Ti
Ti—Pd
Ti—Pt
Ti—Au or magnetically activated shape memory alloys:

Ni—Mn—Ga
Fe—Ni—Ga
Co—Ni—Ga
Fe—Pd
Fe—Pt or shape memory polymers and copolymers

PET-PEO
Polynorbornene
PE-Nylon
PE-PVA
PS-Poly(1,4-Butadiene)
Polyurethanes.

Of course, the shape memory alloys that can be used for implementing the invention may also be heat activated and/or magnetically activated shape memory alloys.

As a result of the invention, the clamping force of the balance spring stud on the balance spring is precisely controlled, in a perfectly reproducible assembly.

The invention claimed is:

1. An assembly, comprising:

a balance spring which comprises two opposite lateral surfaces separated by a reference thickness, and a balance spring stud including a housing dimensioned to receive said balance spring, said stud including, around said housing, at least one one-piece component made of a shape memory alloy and including at least two lugs defining together an air gap and each arranged to rest on one of said opposite lateral surfaces of said balance spring, and wherein, in the free state, the minimum width of said air-gap is greater than the maximum value of said reference thickness when said component is in an open position corresponding to a martensitic structure, and wherein the maximum width of said air-gap is less than the minimum value of said reference thickness when said component is in a closed position corresponding to an austenitic structure, wherein said balance spring locally includes at least one area of lesser thickness whose minimum thickness is said reference thickness for which said stud is devised, and which is surrounded by areas of large thickness whose minimum thickness is greater than said reference thickness.

2. The assembly according to claim 1, wherein said housing of said balance spring stud includes an axial abutment surface arranged to receive in abutment an edge of a said balance spring.

3. The assembly according to claim 1, wherein said stud is made in one piece with said component.

4. The assembly according to claim 1, wherein said balance spring includes an alternation of said areas of lesser thickness and areas of large thickness, for adjustment of the active length of said balance spring through the discrete cooperation of said stud with one of said areas of lesser thickness.

5. The assembly according to claim 1, wherein each said area of lesser thickness has a length substantially equal to the thickness of said lugs of said stud.

6. The assembly according to claim 1, wherein said areas of lesser thickness all have the same profile, and wherein said lugs of said stud each have a complementary profile to the profile of said balance spring which faces said lugs in each said area of lesser thickness.

7. A timepiece movement including at least one assembly according to claim 1.

8. The timepiece including at least one movement according to claim 7.

9. A method for attaching a balance spring to a balance spring stud comprising:

producing said balance spring stud for receiving a balance spring of reference thickness, said stud including, around a housing provided for receiving said balance spring, at least one one-piece component made of a shape memory alloy and including at least two lugs, defining together an air-gap wherein, in the free state of said stud, the minimum width of said air-gap is greater than the maximum value of said reference thickness when said component is in an open position in a martensitic structure, and wherein the maximum width of said air-gap is less than the minimum value of said reference thickness when said component is in a closed position in an austenitic structure;

producing said balance spring, locally including at least one area of lesser thickness whose minimum thickness is said reference thickness, for which said stud is devised, and which is surrounded by areas of large thickness whose minimum thickness is greater than said reference thickness;

effecting a first phase of deformation to open said component in a martensitic state and at a lower temperature than a first transformation start temperature, characteristic of the start of transformation of the martensitic structure into an austenitic structure on heating;

inserting a balance spring into said housing in a determined position or until a stop position is reached; and effecting a second phase of deformation to close said component, in which said lugs are clamped onto said balance spring by heating said component to a higher temperature than a second temperature at which the transformation from the martensitic structure to the austenitic structure ends.

10. A method for attaching a balance spring to a balance spring stud wherein the method includes the following steps:

producing said balance spring stud for receiving a balance spring of reference thickness, said stud including, around a housing provided for receiving said balance spring, at least one one-piece component made of a shape memory alloy and including at least two lugs, defining together an air-gap wherein, in the free state of said stud, the minimum width of said air-gap is greater than the maximum value of said reference thickness when said component is in an open position in a martensitic structure, and wherein the maximum width of said air-gap is less than the minimum value of said reference thickness when said component is in a closed position in an austenitic structure at an operating temperature;

producing said balance spring is produced, locally including at least one area of lesser thickness whose minimum thickness is said reference thickness, for which said stud is devised, and which is surrounded by areas of large thickness whose minimum thickness is greater than said reference thickness;

effecting a first phase of deformation to open said component in a martensitic structure;

inserting said balance spring in said housing, and the spring and housing are properly positioned with respect to each other; and maintaining the spring and the housing in position until the ambient temperature is reached again.

11. The method according to claim 10, further comprising:

producing said balance spring stud for receiving a balance spring of reference thickness, said stud including, around a housing provided for receiving said balance spring, at least one one-piece component made of a shape memory alloy and including at least two lugs, defining together an air-gap wherein, in the free state of said stud, the minimum width of said air-gap is greater than the maximum value of said reference thickness when said component is in an open position in a martensitic structure, and wherein the maximum width of said air-gap is less than the minimum value of said reference thickness when said component is in a closed position in an austenitic structure at an operating temperature;

effecting a first phase of deformation to open said component in a martensitic structure;

performing cooling or heating on said shape memory alloy component;

inserting said balance spring in said housing, and the spring and housing are properly positioned with respect to each other;

maintaining the spring and the housing in position until the ambient temperature is reached again.

* * * * *